US007754350B2

(12) United States Patent
Freling et al.

(10) Patent No.: US 7,754,350 B2
(45) Date of Patent: Jul. 13, 2010

(54) WEAR-RESISTANT COATING

(75) Inventors: Melvin Freling, West Hartford, CT (US); Paul Henry Zajchowski, Enfield, CT (US)

(73) Assignee: United Technologies Corporation, Hartford, CT (US)

( * ) Notice: Subject to any disclaimer, the term of this patent is extended or adjusted under 35 U.S.C. 154(b) by 1071 days.

(21) Appl. No.: 11/415,262

(22) Filed: May 2, 2006

(65) Prior Publication Data

US 2007/0259194 A1 Nov. 8, 2007

(51) Int. Cl.

| | |
|---|---|
| ***B32B 15/00*** | (2006.01) |
| ***B32B 15/01*** | (2006.01) |
| ***B32B 15/04*** | (2006.01) |
| ***C23C 30/00*** | (2006.01) |

(52) U.S. Cl. ..... 428/698; 428/469; 428/668; 428/680; 427/456

(58) Field of Classification Search ..... None
See application file for complete search history.

(56) References Cited

U.S. PATENT DOCUMENTS

| | | | | |
|---|---|---|---|---|
| 3,954,479 | A | 5/1976 | Jahn | |
| 4,728,448 | A | 3/1988 | Sliney | |
| 4,868,069 | A | 9/1989 | Darrow | |
| 4,948,425 | A | 8/1990 | Watanabe et al. | |
| 5,122,182 | A | 6/1992 | Dorfman et al. | |
| 5,336,292 | A * | 8/1994 | Weinl et al. | 75/230 |
| 5,536,022 | A | 7/1996 | Sileo et al. | |
| 5,709,936 | A | 1/1998 | Besmann et al. | |
| 5,763,106 | A | 6/1998 | Blanchard et al. | |
| 5,780,116 | A | 7/1998 | Sileo et al. | |
| 5,939,146 | A | 8/1999 | Lavernia | |
| 6,607,782 | B1 | 8/2003 | Malshe et al. | |
| 6,813,980 | B2 | 11/2004 | Inayama | |
| 6,929,851 | B1 | 8/2005 | Leverenz et al. | |
| 7,235,211 | B2 * | 6/2007 | Griffo et al. | 419/5 |
| 7,484,926 | B2 * | 2/2009 | Suga et al. | 415/108 |
| 2001/0001042 | A1 | 5/2001 | Sinatra et al. | |
| 2002/0029909 | A1 | 3/2002 | Griffo et al. | |
| 2004/0142196 | A1 | 7/2004 | Hajmrle et al. | |
| 2005/0022529 | A1 * | 2/2005 | Takahashi et al. | 60/653 |
| 2005/0112399 | A1 | 5/2005 | Gray et al. | |

FOREIGN PATENT DOCUMENTS

| | | |
|---|---|---|
| CN | 1443868 | 9/2003 |
| DE | 19700835 A1 | 7/1997 |
| EP | 0292250 A1 | 11/1988 |
| EP | 0323185 A2 | 7/1989 |

(Continued)

OTHER PUBLICATIONS

P. Schwarzkopf, R. Kieffer, Refractory Hard Metals, pp. 377, 394, 395, 398, and 401 (The MacMillian Company, New York 1953).

(Continued)

*Primary Examiner*—Jennifer C McNeil
*Assistant Examiner*—Jason L Savage
(74) *Attorney, Agent, or Firm*—Kinney & Lange, P.A.

(57) ABSTRACT

A coating suitable for use as a wear-resistant coating for a gas turbine engine component comprises titanium chrome carbonitride and nickel cobalt.

19 Claims, 1 Drawing Sheet

FOREIGN PATENT DOCUMENTS

| | | | |
|---|---|---|---|
| EP | 0 685 572 | A3 | 9/1996 |
| JP | 55120936 | | 9/1980 |
| JP | 59029819 | A | 2/1984 |
| JP | 02217359 | | 8/1990 |
| JP | 8117984 | A | 5/1996 |
| JP | 2001107221 | | 4/2001 |

OTHER PUBLICATIONS

S. Zhang, et al., "Magnetron sputtering of nanocomposite (Ti, Cr) CN/DLC Coatings", from *Surface and Coatings Technology* 162, 2002, pp. 42-48.

I.A. Podchernyaeva, et al., "Wear and Scaling Resistant Coatings Based on TiCN," from *Powder Metallurgy and Metal Ceramics*, vol. 40, Nos. 5-6, 2001 pp. 247-257.

Official Search Report of the European Patent Office for Application No. 07251829.3-1215, filed May 1, 2007.

Communication Pursuant to article 94(3) EPC from the European Patent Office in counterpart foreign Application No. 07 251 829.3, filed May 1, 2007.

* cited by examiner

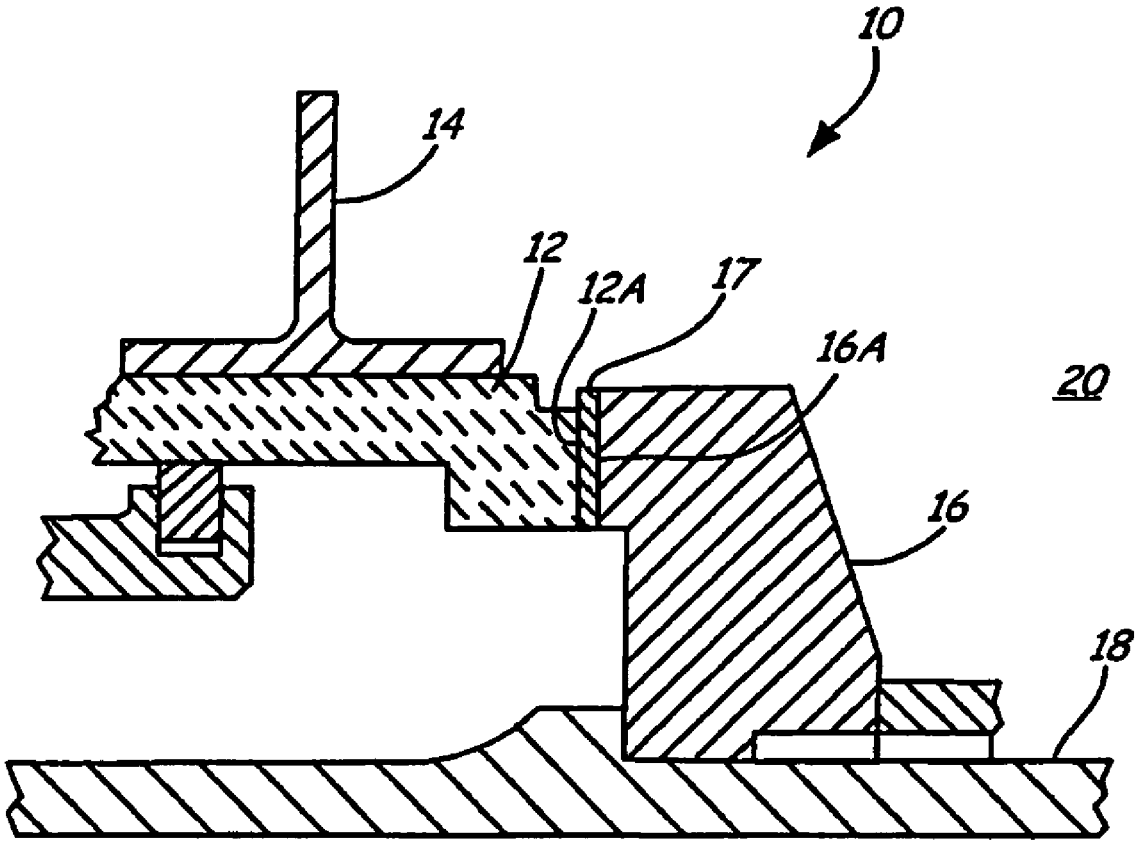
10
14
12
12A
17
16A
20
16
18

WEAR-RESISTANT COATING

BACKGROUND

The present invention relates generally to a coating. More particularly, the present invention relates to a coating suitable for use as a wear-resistant coating for a gas turbine engine component.

A gas turbine engine component, such as a seal plate in a rotary seal mechanism, is often subject to high friction and high temperature operating conditions. After some time in service, the friction typically causes the surface of the component that is exposed to the friction to wear. The wear is generally undesirable, but may be especially undesirable and problematic for a seal mechanism that acts to segregate two or more different compartments of the gas turbine engine. For example, if a sealing component wears (or erodes) and is no longer effective, fluid from one compartment may leak into another compartment. In some portions of a gas turbine engine, failure of the seal mechanism is detrimental to the operation of the gas turbine engine. In those cases, the gas turbine engine may need to be removed from service and repaired or replaced if a part of the seal mechanism wears to the point of seal failure.

A rotary seal mechanism separates two compartments of the gas turbine engine. A rotary seal mechanism typically includes a first component formed of a hard material, such as a carbon seal, that at least in part contacts a surface of a second component formed of a softer material, such as a seal plate, in order to segregate two or more compartments of the gas turbine engine. In some applications, the seal plate rotates as the carbon seal remains fixed, while in other applications, the carbon seal rotates as the seal plate remains fixed. As the seal plate and carbon seal contact one another, the operating temperature and friction levels of both components increase. This may cause the seal plate, which is formed of a softer material than the carbon seal, to wear and deteriorate. The relative vibration between the seal plate and the carbon seal during the gas turbine engine operation may also cause frictional degradation and erosion of the seal plate.

It is important to minimize the wear of the seal plate in order to help prevent the rotary seal mechanism from failing. In order to mitigate the wear and deterioration of the seal plate and extend the life of the seal plate, a wear-resistant coating may be applied to at least one of the contacting surfaces (i.e., the surface of the seal plate that contacts the carbon seal). However, it has been found that many existing wear-resistant coatings crack and spall under the increasingly high engine speeds and pressures. Therefore, it would be desirable to have improved wear-resistant coatings.

BRIEF SUMMARY

The present invention is a wear-resistant coating suitable for a gas turbine engine component, where the coating comprises titanium chrome carbonitride and nickel cobalt.

BRIEF DESCRIPTION OF THE DRAWING

The FIGURE is a partial cross-sectional view of a rotary seal, which includes a carbon seal and a seal plate.

DETAILED DESCRIPTION

The present invention is both a coating suitable for use as a wear-resistant coating for a substrate and a method for coating a gas turbine engine component with the inventive coating. A coating in accordance with the present invention includes at least titanium chrome carbonitride and nickel cobalt (NiCo). In embodiments, the coating includes about 50 to about 90 weight percent titanium chrome carbonitride and about 10 to about 50 weight percent nickel cobalt. The wear-resistant coating of the present invention is particularly suitable for applying on a surface of a gas turbine engine component that is subject to high friction operating conditions, such as a seal plate of a rotary seal mechanism. However, the coating may be used with any suitable substrate that is subject to wearing conditions, including other gas turbine engine components having a hard-faced mating surface. The coating is configured to bond to many materials without the use of a bond coat, including many steels and nickel alloys. However, if the coating does not bond to the substrate, a suitable bond coat known in the art may be employed.

As turbine engine speeds and pressures have increased in order to increase engine efficiency, it has been found that many existing wear-resistant coatings, such as nickel chrome/chromium carbide, crack and spall. Such cracking and spalling is undesirable and may shorten the life of the component on which the wear-resistant coating is applied. At the very least, the early failure of the wear-resistant coating may require the component to be temporarily removed from service in order to repair/replace the wear-resistant coating.

The FIGURE shows a partial cross-sectional view of a typical gas turbine engine seal mechanism 10. Seal mechanism 10 includes an annular carbon seal ring 12, which is carried by seal carrier 14, and an annular seal plate 16, which is carried by rotating shaft 18. The interface of carbon seal 12 and seal plate 16 form a seal that may, for example, help contain a fluid within compartment 20. For example, seal mechanism 10 may be used in a bearing compartment of a gas turbine engine to limit leakage of fluid, such as lubricating oil, from compartment 20 into other parts of the gas turbine engine. In embodiments, carbon seal ring 12 is formed of a carbonaceous material and seal plate 16 is formed of a metal alloy, such as steel, a nickel alloy, or combinations thereof.

Seal carrier 14 biases face 12A of carbon sealing ring 12 against face 16A of seal plate 16, such as by a spring force. Shaft 18 carries seal plate 16, and as shaft 18 rotates, face 16A of seal plate 16 engages with face 12A of carbon seal 12, thereby generating frictional heat. The frictional heat may cause wear at the interface of seal plate 16 and carbon seal 12 (i.e., where face 12A of carbon seal contacts face 16A of seal plate 16).

In order to limit leakage of fluid from compartment 20, it is important to maintain contact between face 12A of carbon seal 12 and face 16A of seal plate 16. Yet, such contact may cause seal plate 16 and/or carbon seal 12 to wear. In order to help maintain the functionality of the gas turbine engine, it is important for seal mechanism 10 to withstand the high-speed conditions, and for face 16A of seal plate 16 to be wear-resistant. Typically, carbon seal 12 is formed of a harder and more wear-resistant material than seal plate 16, and the rate of wear is slower for carbon seal 12 than it is for seal plate 16. As such, a titanium chrome carbonitride and nickel cobalt wear-resistant coating 17 in accordance with the present invention may be applied to at least a part of face 16A of seal plate 16 that contacts face 12A of carbon seal 12 (coating 17 is not drawn to scale in the figure). Coating 17 helps prevent erosion and deterioration of face 16A of seal plate 16 that results from contacting face 12A of carbon seal 12 (e.g., from friction), which helps prevent seal mechanism 10 from failing. Coating 17 can be applied to any suitable thickness, and in embodiments may be applied to a thickness of about 0.0508 millimeters (2 mils) to about 0.508 millimeters (20 mils).

In embodiments, the carbon seal face 12A may be coated with coating 17, either in addition to or instead of coating the seal plate face 16A with coating 17.

Coating 17 of the present invention may be applied to a substrate with any suitable method, such as a thermal spraying method (including plasma spraying) or a vapor deposition method. In the embodiment discussed below, a high velocity oxyfuel (HVOF) thermal spray process is used to apply the titanium chrome carbonitride and nickel cobalt coating to a gas turbine engine component. In a HVOF thermal spray process, a high velocity gas stream is formed by continuously combusting oxygen and a gaseous or liquid fuel. A powdered form of the coating is injected into the high velocity gas stream and the coating is heated to near its melting point, accelerated, and directed at the substrate to be coated. A coating applied with a HVOF process results in a hardness in the upper limits of the range discussed below. This is partially attributable to the overlapping, lenticular particles (or "splats") of coating material that are formed on the substrate.

The HVOF process imparts substantially more kinetic energy to the powder being deposited than many existing thermal spray coating processes. As a result, an HVOF applied coating exhibits considerably less residual tensile stresses than other types of thermally sprayed coatings. Oftentimes, the residual stresses in the coating are compressive rather than tensile. These compressive stresses also contribute to the increased density and hardness values as compared to other coating application methods.

One of ordinary skill in the art will appreciate that HVOF thermal spray process parameters vary with the use of a different spray gun/system and are dependent on many variables, including but not limited to, the type and size of powder employed, the fuel gas type, the spray gun type, and the part configuration. Accordingly, the parameters set forth herein may be used as a guide for selecting other suitable parameters for different operating conditions, different titanium chrome carbonitride and nickel cobalt powder compositions, and different components. The parameters described herein were specifically developed for use with a Sulzer Metco Diamond Jet Hybrid HVOF spray system using hydrogen as a fuel gas and a standard nozzle designed for hydrogen-oxygen combustion. In alternate embodiments, the parameters can be modified for use with other HVOF systems and techniques using other fuels.

EXAMPLE

An exemplary titanium chrome carbonitride and nickel cobalt coating 17, comprising about 60 weight percent titanium chrome carbonitride and about 40 weight percent nickel cobalt, was applied to seal plate face 16A via a HVOF process. Prior to coating seal plate face 16A with coating 17, seal plate 16 was cleaned and surfaces of seal plate 16 that were not to be coated were masked. Seal plate face 16A was then grit blasted to provide a roughened surface for improving coating 17 adhesion thereon. The exemplary titanium chrome carbonitride and nickel cobalt coating 17 was then applied to seal plate face 16A via the HVOF process described below.

The titanium chrome carbonitride and nickel cobalt powder was fed into the spray gun at a rate of about 30 grams/minute to about 55 grams/minute. A nitrogen carrier gas flow rate of between 0.7080 cubic meters/hour ($m^3$/hr) (25 standard cubic feet hour (scfh)) and about 0.9912 $m^3$/hr (35 scfh) at standard conditions was utilized to inject the powder into the plume centerline of the HVOF system. Standard conditions are herein defined as about room temperature (about 20° C. to about 25° C.) and about one atmosphere of pressure (101 kPa). The oxygen gas flow to the gun was between about 9.91 $m^3$/hr (350 scfh) and about 15.58 $m^3$/hr (550 scfh), and the hydrogen gas range flow was between about 39.65 $m^3$/hr (1400 scfh) and about 46.73 $m^3$/hr (1650 scfh). Nitrogen flowing at a rate of about 18.41 $m^3$/hr(650 scfh) to about 25.49 (900 scfh) was used as a cooling/shroud gas. In alternate embodiments, other suitable gases (e.g., air) may be used as a cooling/shroud gas, and may be flowed in at any suitable rate. In general, those skilled in the art appreciate that the coating hardness can be increased by decreasing the powder flow rate, decreasing the gun to part distance, and/or increasing the oxygen flow rate. External cooling gas may be employed to prevent excess part temperatures.

During spray deposition of coating 17, seal plate 16 was rotated to produce surface speeds of about 23.23 surface meters per minute (smpm) (250 surface feet per minute (sfpm)) to about 46.46 smpm (500 sfpm). A spray gun was located on the outer diameter of seal plate 16 and traversed in a horizontal plane across seal plate face 16A at a speed of about 0.152 meters per minute (6 inches per minute) to about 1.016 meters per minute (40 inches per minute) and at an angle of about 45 to 90 degrees (preferably 90 degrees or normal) to seal plate face 16A. The distance between the spray gun and the part (i.e., the gun to part distance) can vary from about 20.32 centimeters (8 inches) to about 30.48 centimeters (12 inches), and in this example the distance between the spray gun and seal plate 16 was about 26.67 centimeters (10.5 inches). In general, those skilled in the art appreciate that the component rotation speed, surface speed, gun traverse rate, and component size affect the part temperature during spraying. External gas cooling may be employed to prevent excess part temperatures, if desired.

After the seal plate face 16A was coated, a wear test was performed on this seal mechanism 10. The wear test involved rotating the seal plate 16 (while engaged with the carbon seal 12) at five speed ranges while three separate load levels were applied to the seal mechanism 10. The total run time for the wear test was about 4 hours. As shown in the table below, the three load levels were about 55.16 kilopascals (kPa) (8 pounds per square inch (psi)), 124.11 kPa (18 psi), and 172.37 kPa (25 psi), while the five speed levels were about 9,900 revolutions per minute (rpm), 13,650 rpm, 17,650 rpm, 21,050 rpm, and 24,750 rpm. This coating 17 exhibited a coefficient of friction of about 0.52 against itself. It was found that the seal mechanism 10 exhibited optimal wear up until the last phase of the test, where a 172.37 kPa (25 psi) load was applied to the seal mechanism while seal plate 16 was rotated at about 24,750 rpm. It was also found that the surface temperature of seal plate face 16A and coating 17 was about 225.56° C. (438 ° F.) after the 172.37 kPa (25 psi) load level was applied to seal plate 16 while the seal plate was rotated at 21,050 rpm. Further, after a 172.37 kPa (25 psi) load level was applied to seal plate 16, coating 17 exhibited a wear of about 0.0022 centimeters (0.0009 inches).

Wear Test Results

| Speed (rpm)/Load (psi) | 55.16 kPa (8 psi) Temperature of Coating and Seal Plate After 80 Minutes | 124.11 kPa (18 psi) Temperature of Coating and Seal Plate After 80 Minutes | 172.37 kPa (25 psi) Temperature of Coating and Seal Plate After 80 Minutes |
|---|---|---|---|
| 9900 rpm | 135.56° C. (276° F.) | 175° C. (347° F.) | 188.89° C. (372° F.) |
| 13650 rpm | 142.22° C. (288° F.) | 181.67° C. (359° F.) | 212.78° C. (415° F.) |
| 17650 rpm | 137.78° C. (280° F.) | 194.44° C. (382° F.) | 213.33° C. (416° F.) |
| 21050 rpm | 146.67° C. (296° F.) | 206.67° C. (404° F.) | 225.56° C. (438° F.) |
| 24750 rpm | 180° C. (356° F.) | 225° C. (437° F.) | 282.22° C. (540° F.) |

In general, the hardness values of the coatings of the present invention are comparable to existing coatings. Specifically, a titanium chrome carbonitride and nickel cobalt coating including about 50 to about 90 weight percent titanium chrome carbonitride and about 10 to about 50 weight percent nickel cobalt exhibits a hardness in a range of about 700 to about 1000 Vickers Hardness (HV). More specifically, it was found that a coating including about 65 weight percent titanium chrome carbonitride and about 35 weight percent nickel cobalt exhibits a hardness of about 815 HV. It was also found that a coating including about 60 weight percent titanium chrome carbonitride and about 40 weight percent nickel cobalt exhibits a hardness in a range of about 720 to about 750 HV.

Although the hardness values of the inventive coating are comparable to many existing coatings, it is believed that the inventive coating is capable of withstanding higher engine speeds and pressures than some existing wear-resistant coatings. This may be partially attributable to the improved thermal conductivity values of the inventive coatings of this invention.

While seal mechanism 10 was described herein as a general example of a gas turbine engine component that is subject to wearing conditions, the coatings of the present invention are also suitable for applying to other components of a gas turbine engine that are exposed to wearing conditions.

The terminology used herein is for the purpose of description, not limitation. Specific structural and functional details disclosed herein are not to be interpreted as limiting, but merely as bases for teaching one skilled in the art to variously employ the present invention. Although the present invention has been described with reference to preferred embodiments, workers skilled in the art will recognize that changes may be made in form and detail without departing from the spirit and scope of the invention.

The invention claimed is:

1. A coating for a gas turbine engine component, the coating comprising:

titanium chrome carbonitride; and nickel cobalt, wherein the coating comprises about 50 to about 90 weight percent of titanium chrome carbonitride and about 10 to about 50 weight percent of nickel cobalt, and wherein the coating exhibits a hardness in a range of about 700 to about 1000 Vickers Hardness.

2. The coating of claim 1, wherein the coating consists essentially of about 50 to about 90 weight percent of titanium chrome carbonitride and about 10 to about 50 weight percent of nickel cobalt.

3. The coating of claim 1, wherein the coating is about 2 to about 20 mils thick.

4. The coating of claim 1, wherein the coating exhibits a hardness in a range of about 800 to about 850 Vickers Hardness.

5. The coating of claim 1, wherein the gas turbine engine component is a seal plate.

6. The coating of claim 1, wherein the coating is applied onto the gas turbine engine component with a process selected from a group consisting of: plasma spraying, thermal spraying, and vapor deposition.

7. The coating of claim 1, wherein the coating is applied onto the gas turbine engine component with a high velocity oxyfuel process such that the coating defines overlapping lenticular particles.

8. The coating of claim 7, wherein the high velocity oxyfuel process comprises:

a powder feed rate of about 30 to about 55 grams/minute;

a nitrogen carrier gas flow rate of about 25 to about 35 cubic feet per hour at standard conditions;

an oxygen flow rate of about 350 to about 550 cubic feet per hour at standard conditions;

a hydrogen gas flow rate of about 1450 to about 1650 cubic feet per hour at standard conditions; and a gun-to-part distance of about 8 to about 12 inches.

9. The coating of claim 1, wherein the coating consists essentially of:

titanium chrome carbonitride; and nickel cobalt.

10. The coating of claim 1, wherein the coating exhibits a hardness in a range of about 720 to about 750 Vickers Hardness.

11. The coating of claim 1, wherein the coating exhibits a hardness in a range of about 700 to less than 800 Vickers Hardness.

12. The coating of claim 1, wherein the coating exhibits a hardness in a range of about 700 to about 750 Vickers Hardness.

13. A seal assembly for a gas turbine engine, the seal assembly comprising:

a first seal member including a first surface;

a second seal member including a second surface, wherein at least a part of the second surface is configured to engage with at least a part of the first surface, and wherein at least a portion of at least one of the first surface and the second surface that is configured to engage with the part of the first surface includes a coating comprising about 50 to about 90 weight percent titanium chrome carbonitride and about 10 to about 50 weight percent nickel cobalt and exhibiting a hardness in a range of about 700 to about 1000 Vickers Hardness.

14. The seal assembly of claim 13, wherein the first seal member is a carbon seal ring and the second seal member is a seal plate.

15. The seal assembly of claim 13, wherein the coating consists essentially of about 50 to about 90 weight percent of titanium chrome carbonitride and about 10 to about 50 weight percent of nickel cobalt.

16. The seal assembly of claim 13, wherein the coating is about 2 to about 20 mils thick.

17. The seal assembly of claim 13, wherein the coating exhibits a hardness in a range of about 700 to about 750 Vickers Hardness.

18. The seal assembly of claim 13, wherein the coating exhibits a hardness in a range of about 720 to about 750 Vickers Hardness.

19. The seal assembly of claim 13, wherein the coating is applied onto the portion of at least one of the first surface and the second surface with a high velocity oxyfuel process such that the coating defines overlapping lenticular particles.

* * * * *